US012054230B2

(12) United States Patent
Godoy

(10) Patent No.: US 12,054,230 B2
(45) Date of Patent: Aug. 6, 2024

(54) BACKREST PROVIDED WITH A SUPPORT FOR FASTENING A WEIGHT POCKET

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 0 days.

(21) Appl. No.: 17/969,789

(22) Filed: Oct. 20, 2022

(65) Prior Publication Data

US 2023/0150626 A1 May 18, 2023

(30) Foreign Application Priority Data

Nov. 12, 2021 (IT) ..... 102021000028805

(51) Int. Cl.
*B63C 11/30* (2006.01)
*B63C 11/02* (2006.01)

(52) U.S. Cl.
CPC ..... *B63C 11/02* (2013.01); *B63C 2011/026* (2013.01)

(58) Field of Classification Search
CPC ... B63C 11/02; B63C 2011/026; B63C 11/30; B63C 2011/2281; B63C 2011/303; B63C 11/22; A62B 35/0006
See application file for complete search history.

(56) References Cited

U.S. PATENT DOCUMENTS 2,982,105 A * 5/1961 Akers ..... B63C 11/02 2/81
3,436,777 A * 4/1969 Greenwood ..... B63C 11/30 128/202.14
3,957,183 A 5/1976 Gadberry
4,779,554 A 10/1988 Courtney
4,877,167 A * 10/1989 McNemar ..... A45F 5/02 292/318
4,887,932 A * 12/1989 Toth ..... B63C 11/30 405/186
5,205,672 A * 4/1993 Stinton ..... B63C 11/30 405/186
5,516,233 A * 5/1996 Courtney ..... B63C 11/02 441/106

(Continued)

OTHER PUBLICATIONS

Italian Search Report and Written Opinion issued in IT 202100028805 dated Jun. 28, 2022.

*Primary Examiner* — Edwin J Toledo-Duran
(74) *Attorney, Agent, or Firm* — TROUTMAN PEPPER HAMILTON SANDERS LLP

(57) ABSTRACT

A backrest for a scuba diver comprising a shaped plate supporting at least one air cylinder, at least a first strap comprising an upper right portion configured to fit around the scuba diver's right shoulder, an upper left portion configured to fit around the scuba diver's left shoulder and a lower portion configured to fit around the scuba diver's abdomen, wherein the shaped plate has a first right slide-through element and a first left slide-through element adapted to connect the upper right portion and the upper left portion, respectively, to the lower portion of the first strap, at least one weight pocket constrained to the lower portion of the first strap, wherein there is provided an anti-torsion means connecting the at least one weight pocket to the shaped plate and configured to oppose the torsion of the first strap in proximity to at least one of the first slide-through elements.

6 Claims, 4 Drawing Sheets

(56) References Cited

U.S. PATENT DOCUMENTS 5,641,247 A * 6/1997 Seligman ..... B63C 11/30 441/106
5,746,542 A * 5/1998 Carmichael ..... B63C 11/30 224/934
5,855,454 A * 1/1999 Courtney ..... B63C 9/155 441/108
5,860,769 A * 1/1999 Seligman ..... A44B 11/263 224/264
5,902,073 A * 5/1999 Eungard ..... B63C 11/30 405/187
5,944,450 A * 8/1999 Anderson ..... B63C 11/30 441/106
6,203,246 B1 * 3/2001 Courtney ..... B63C 11/2245 405/185
6,558,082 B1 * 5/2003 Courtney ..... B63C 9/1255 441/89
6,755,594 B1 * 6/2004 Jacoway ..... B63C 11/30 441/106
6,758,635 B1 * 7/2004 Feng ..... B63C 11/30 441/106
7,458,751 B2 * 12/2008 Carmichael ..... B63C 11/30 441/106
8,272,809 B2 * 9/2012 Carmichael ..... B63C 11/30 441/106
9,296,451 B2 * 3/2016 Toth ..... A44B 11/2592
2002/0057946 A1 * 5/2002 Beltrani ..... B63C 11/2245 405/186
2002/0067955 A1 * 6/2002 Carmichael ..... B63C 11/30 405/186
2005/0098597 A1 * 5/2005 Cottrell ..... B63C 11/30 224/629
2005/0235393 A1 * 10/2005 Rockwell ..... A41D 13/0125 2/108
2008/0304913 A1 * 12/2008 Toth ..... B63C 11/30 405/186
2009/0136301 A1 * 5/2009 Carmichael ..... B63C 11/30 405/186
2009/0324340 A1 * 12/2009 Crow ..... B63C 11/30 405/186
2011/0016674 A1 * 1/2011 Jablonski ..... A45F 3/10 24/182
2011/0305520 A1 * 12/2011 West ..... B63C 7/26 362/234
2015/0232159 A1 * 8/2015 Masutani ..... B63C 11/30 405/186
2016/0089554 A1 * 3/2016 Perner ..... A62B 35/0006 182/3
2022/0087402 A1 * 3/2022 Grenier ..... A45F 3/14
2022/0183449 A1 * 6/2022 Landano ..... A45F 3/005
2023/0083750 A1 * 3/2023 Czernik ..... A62B 35/0006 405/186

* cited by examiner

BACKREST PROVIDED WITH A SUPPORT FOR FASTENING A WEIGHT POCKET

CROSS REFERENCE TO RELATED APPLICATIONS

This application claims benefit of priority to Italian Patent Application No. 102021000028805, filed Nov. 12, 2021, the entire contents of which are hereby incorporated by reference.

FIELD

The present invention relates to a backrest for a scuba diver with a weight pocket.

BACKGROUND

Backrests for scuba divers, that is, back support elements for one or more air cylinders for scuba diving, have been present on the market for some time in an extreme variety of shapes and sizes, both in a simple configuration and in a configuration integrated into a buoyancy control device (BCD), and are constrained to the scuba diver's body in various ways, generally with flexible straps.

It is well known that a plurality of straps and a corresponding plurality of connections and closures are generally interpreted by a scuba diver as an annoyance during donning, and even more so during doffing, which, under emergency conditions, may need to be simple and rapid.

As is known, there are backrests for scuba divers on the market that are provided with a single strap for constraining them to the diver's body and in which the strap, in a first upper part thereof, acts as a support for the weight of the cylinder(s) on the diver's shoulders and, in a second part thereof, suitably routed, allows a coupling of the two ends in an abdominal position.

As is known, as an alternative or in addition to the traditional weight belt, the weight carried by a scuba diver for underwater diving can be inserted in pockets directly fashioned in the buoyancy control device, or in independent pockets that are suitably configured to be directly fastened onto the constraining strap of the backrest, in the abdominal portion constraining it to the scuba diver's body.

It is likewise known that such pockets, commonly defined as weight pockets, when loaded with the weight, tend to subject the constraining strap of the backrest to a torsional load, typically in proximity to a first slide-through element, thus precluding the smooth sliding required by the scuba diver at the time of donning (and/or doffing) and adjusting the backrest.

A need is thus felt to improve the structure of the known backrests for scuba diving.

SUMMARY

The technical task of the present invention, therefore, is to provide a backrest for a scuba diver diving that enables the aforementioned technical drawbacks of the prior art to be eliminated.

Within the scope of this technical task, one object of the invention is to provide a backrest for a scuba diver constrained to the diver's body with a single strap enabling the support of at least one weight pocket in a simple and effective manner.

Another object of the invention is to provide a backrest for a scuba diver configured to oppose the torsion of the weight pocket on the single strap constraining it in the abdominal position.

Yet a further object of the invention is to provide a backrest for a scuba diver wherein the adjustment and/or release of the single strap constraining it in the abdominal position is extremely simple and not hindered by the torsion applied by the weight pocket on the strap itself.

The technical task, as well as these and other objects, are achieved according to the present invention by providing a backrest for a scuba diver comprising a shaped plate for supporting at least one air cylinder, at least a first strap comprising an upper right portion configured to fit around the scuba diver's right shoulder, an upper left portion configured to fit around the scuba diver's left shoulder and a lower portion configured to fit around the scuba diver's abdomen, said shaped plate having a first right slide-through element and a first left slide-through element, adapted to connect said upper right portion and said upper left portion, respectively, to said lower portion of said first strap, at least one weight pocket, said at least one weight pocket being constrained to said lower portion of said first strap, characterised in that there is provided an anti-torsion means connecting said at least one weight pocket to said shaped plate and configured to oppose the torsion of said first strap in proximity to at least one of said first slide-through elements.

In a preferred embodiment, said anti-torsion means comprises a fastening block for fastening the weight pocket to the shaped plate.

In one embodiment, said at least one fastening block is configured not to interfere with said first right slide-through element or with said first left slide-through element of said first strap.

Other features of the present invention are defined, moreover, in the subsequent claims.

BRIEF DESCRIPTION OF THE DRAWINGS

Additional features and advantages of the invention will become more apparent from the description of a first preferred but not exclusive embodiment of the backrest for a scuba diver according to the invention, illustrated by way of non-limiting example in the appended drawings, in which.

DETAILED DESCRIPTION

Figure 1:
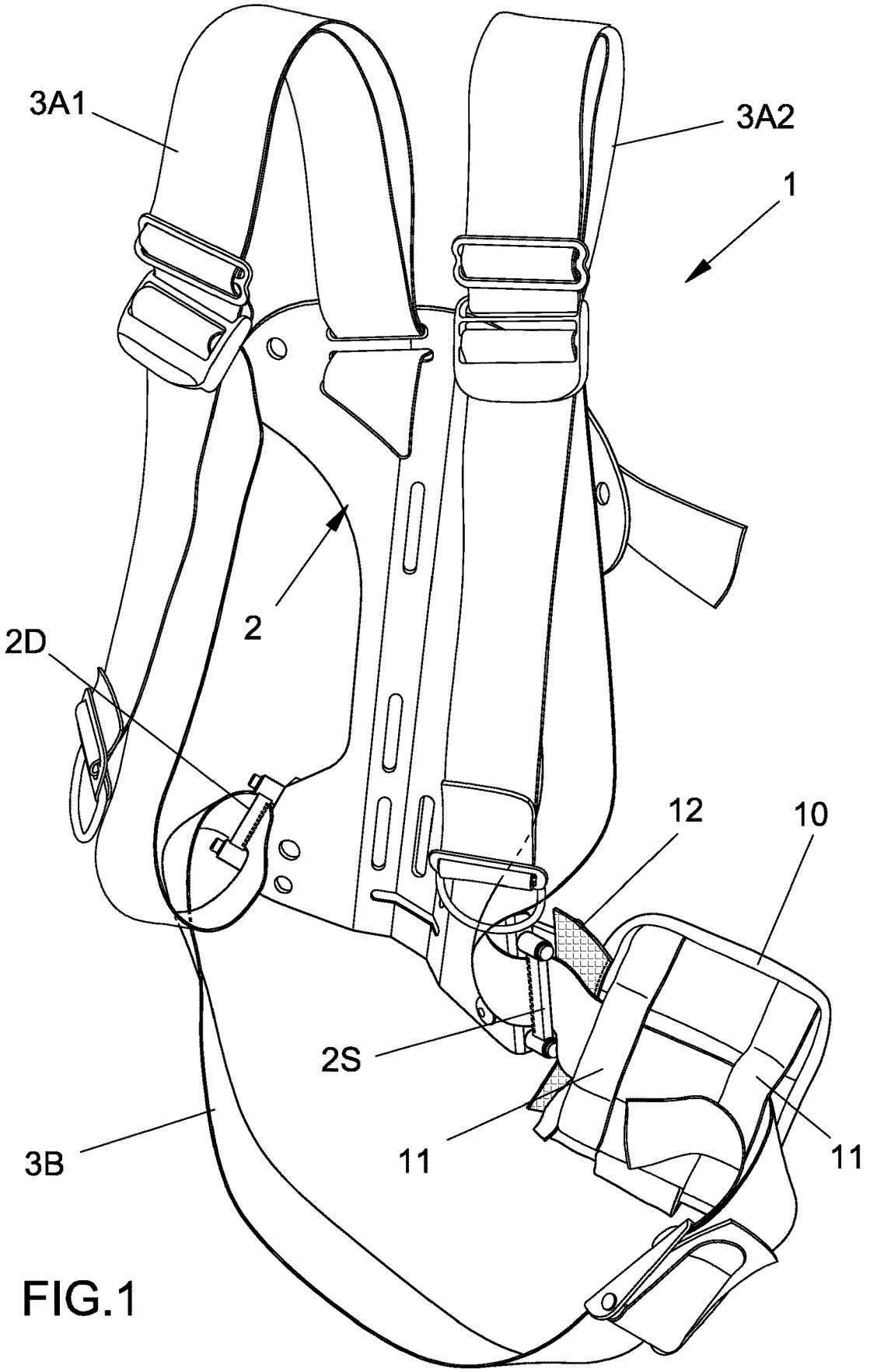
FIG. 1 shows an overall front view of the backrest, the constraining strap and the weight pocket.
Figure 2:
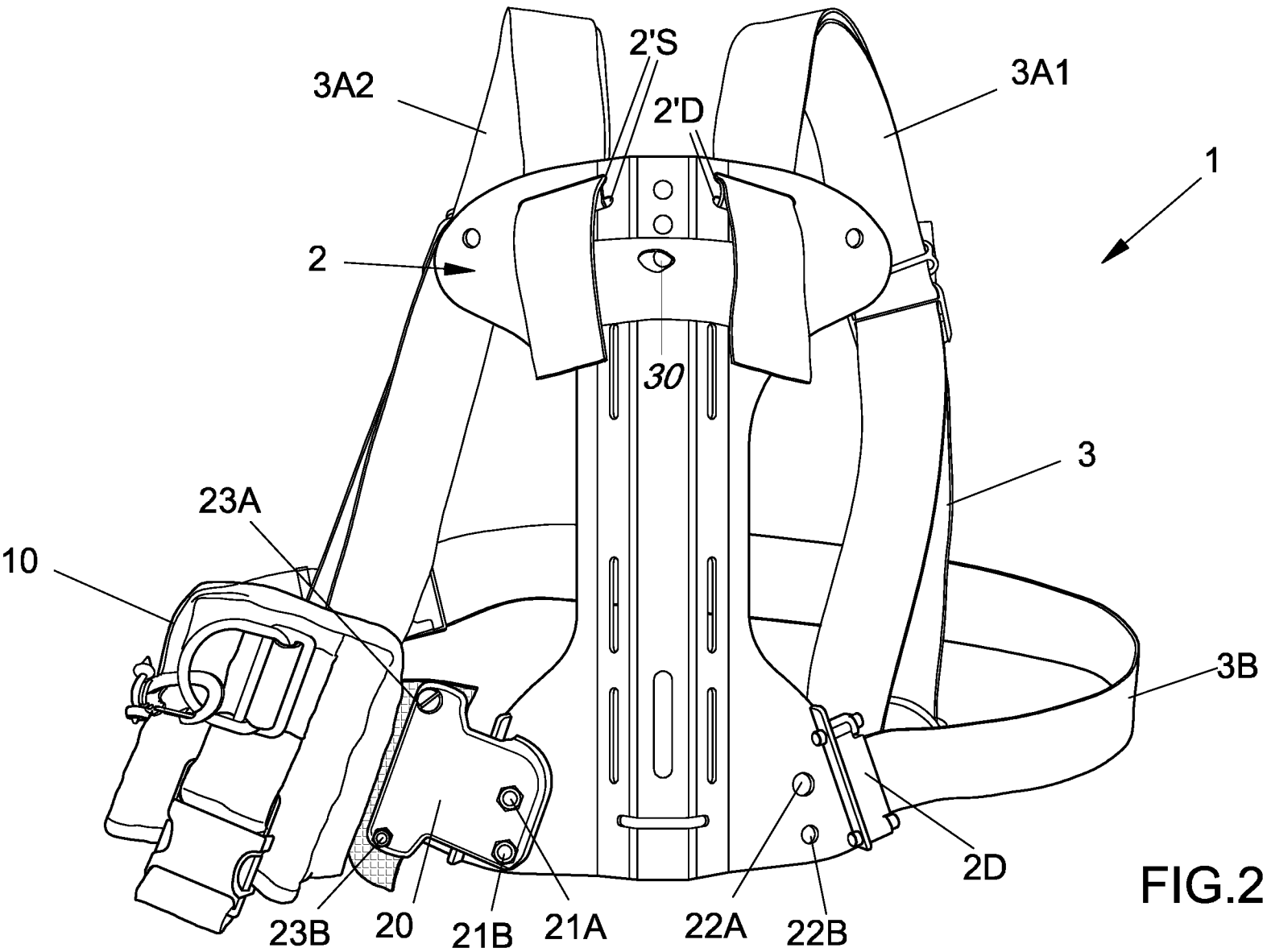
FIG. 2 shows an overall rear view of the backrest, the constraining strap and the weight pocket.
Figure 3:
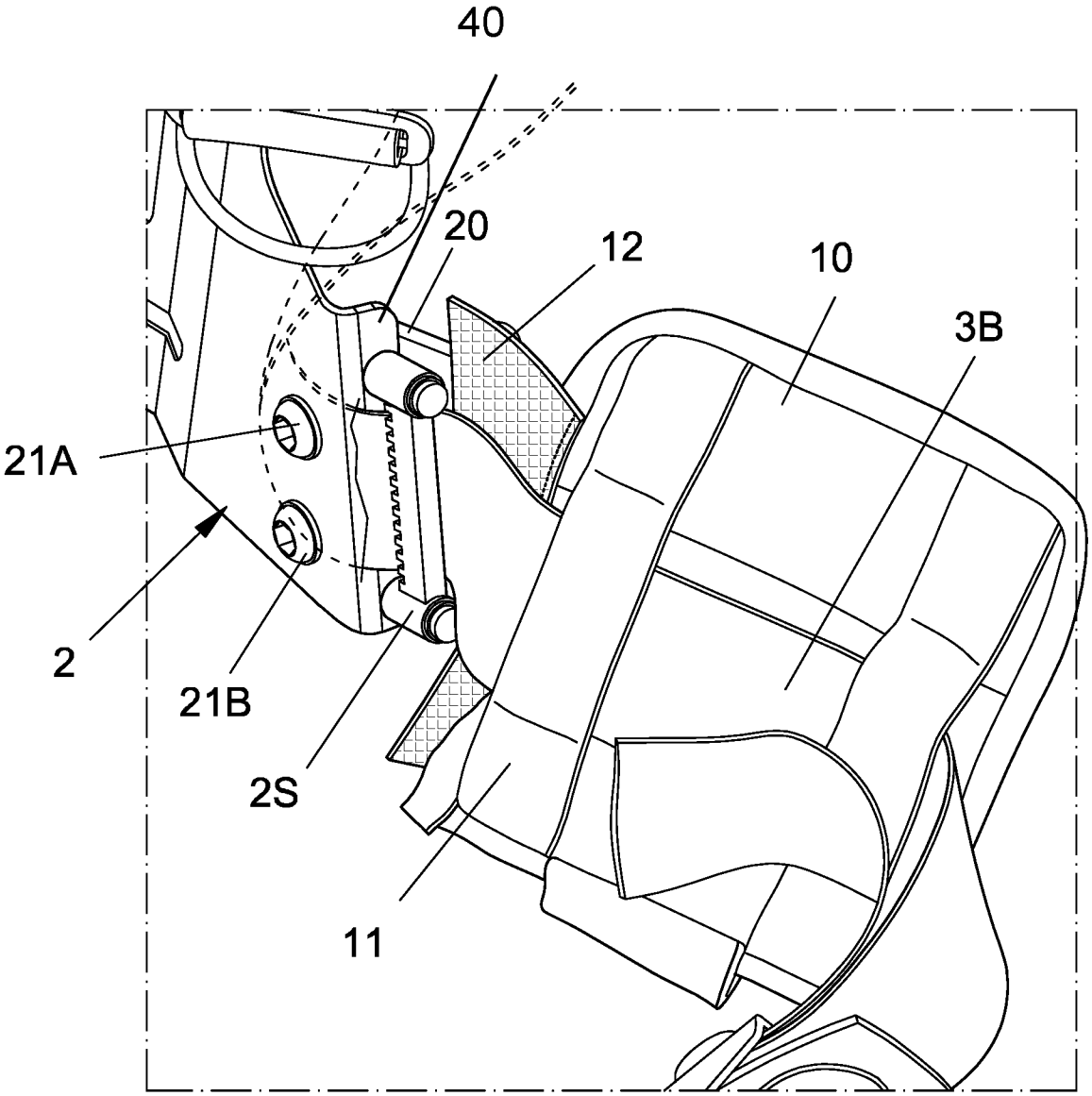
FIG. 3 shows a detailed front view of the left wing of the backrest, the fastening block and the weight pocket.
Figure 5A:
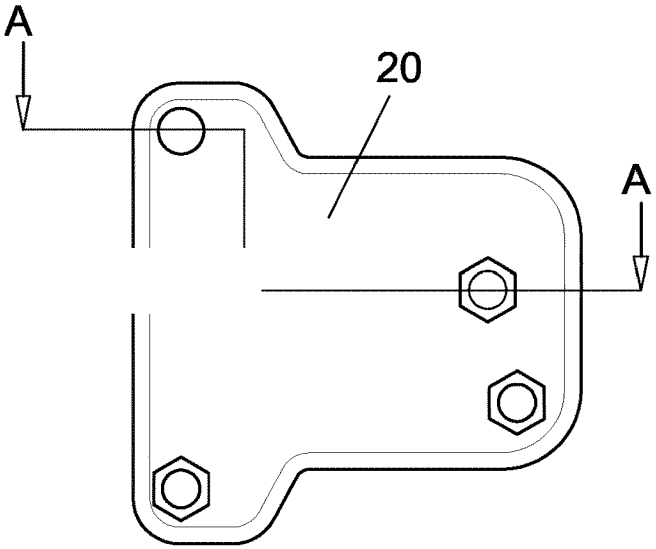
FIG. 5A shows a front view of the fastening block for the weight pocket.
Figure 5B:
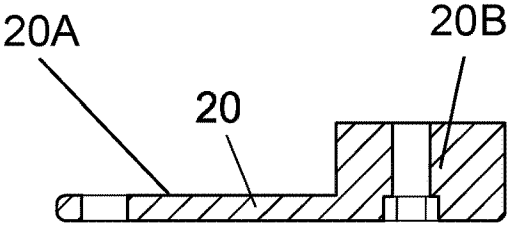
FIG. 5 B shows a detailed section AA of the fastening block for the weight pocket.
Figure 4:
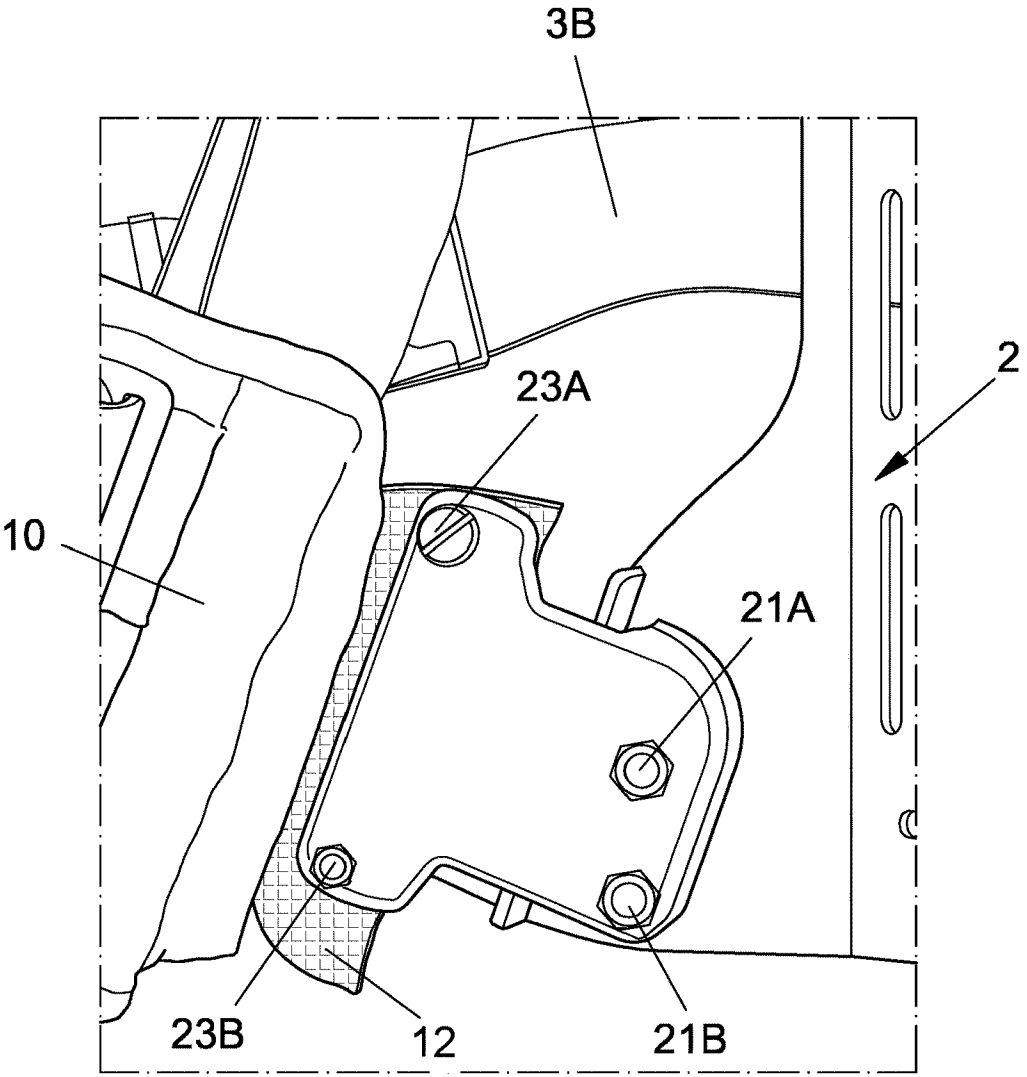
FIG. 4 shows a detailed rear view of the left wing of the backrest, the fastening block and the weight pocket.

The following detailed description makes reference to the appended drawings, which form a part thereof.

In the drawings, similar reference numbers typically identify similar components, unless the context indicates otherwise.

The illustrative embodiments described in the detailed description and in the drawings are not intended to be limiting.

Other embodiments may be used and other modifications may be introduced without departing from the spirit or the scope of the subject matter presented herein.

The aspects of the present description, as generally described in the present context and illustrated in the figures, may be arranged, replaced, combined and designed in a wide variety of different configurations, which are all explicitly envisaged and are part of this description.

With reference to the above-mentioned figures, they show a backrest for a scuba diver denoted in its entirety by the reference number 1.

The backrest for a scuba diver 1 comprises a shaped plate 2 for supporting at least one air cylinder (not shown in the drawings), at least a first strap 3 comprising an upper right portion 3A1 configured to fit around the scuba diver's right shoulder, an upper left portion 3A2 configured to fit around the scuba diver's left shoulder and a lower portion 3B configured to fit around the scuba diver's abdomen, a first right slide-through element 2D and a first left slide-through element 2S, adapted to connect the upper portions 3A1 and 3A2, respectively, to the lower portion 3B of the first strap 3.

The upper portions 3A1 and 3A2 of the first strap 3 are disposed through specific pass-through elements 2'D and 2'S of the shaped plate 2 and are fastened to the shaped plate 2 preferably by means of one or more specific bolts (not shown) tightened in one or more through-holes 30 of the shaped plate 2.

The backrest for a scuba diver 1 comprises at least one weight pocket 10 constrained to the lower portion 3B of the first strap 3.

The weight pocket 10 is typically made of flexible textile materials and on the rear has one or more second slide-through elements 11 by means of which it is constrained to the first strap 3.

Conveniently, innovatively and advantageously according to the present invention, there is provided an anti-torsion means for the lower portion 3B of the first strap 3.

The anti-torsion means connects the weight pocket 10 to the shaped plate 2 and is configured to oppose the torsion of the first strap 3 caused by the weight of the weight pocket 10 on the first strap 3 in proximity to at least one first slide-through element: in the drawings the first left through element 2S is typically illustrated and the description refers to that zone; symmetrically, and/or additionally, the drawings and description may refer to the right zone.

Conveniently, innovatively and advantageously according to the present invention, the anti-torsion means comprises at least one fastening block 20, constrained respectively to the shaped plate 2 and the weight pocket 10.

The fastening block 20 has a preferably removable means of constraint to the shaped plate so that it can be supplied together with the weight pocket 10 as a kit for adaptation to backrests already on the market.

The constraint of the fastening block 20 to the shaped plate 2 is typically achieved with two small bolts 21 A and 21 B that engage in mating holes 22 A and 22 B in the lower wing of the shaped plate 2.

The constraint of the fastening block 20 to the weight pocket 10 is typically achieved with two small bolts 23 A and 23 B that engage in one side of a suitable connecting piece 12 protruding from the weight pocket 10: the connecting piece 12 can be flexible or adequately rigid or stiffened so as to limit the suitable degree of freedom of the weight pocket 10 for adaptation to the scuba diver's hip.

Conveniently, the side of the connecting piece 12 fastened to the fastening block 20 has a length that is no less than the width of the first strap 3.

Conveniently, the fastening block 20 is configured not to interfere with the first left slide-through element 2S.

The fastening block 20 in particular has a flat longitudinal base 20 A having at one end the holes for the bolts 23 A, 23 B for fastening to the piece 12 and at the longitudinally opposite end the holes for the bolts 21 A, 21 B for fastening to the backrest, provided on a thickened portion 20 B of the longitudinal base 20 A which is on top of an orthogonal terminal flap 40 of the backrest.

The operation of a backrest for a scuba diver according to the invention appears clear from what is described and illustrated and, in particular, is substantially the following.

The first strap 3 is engaged at least in the first left slide-through element 2S of the shaped plate 2 and then in the second slide-through elements 11 of the weight pocket 10.

The weight pocket 10 is constrained at the connecting piece 12 to the fastening block 20 rigidly constrained to the shaped plate 2.

The fastening block 20 is configured not to interfere with the first left slide-through element 2S of the first strap 3.

The weight of the weight pocket 10 is substantially transferred to the shaped plate 2 by means of the fastening block 12.

The weight of the weight pocket 10 does not act, therefore, on the first strap 3 through the second slide-through elements 11, and thus does not apply a torsion action on the first strap 3.

The first strap 3 remains free to slide in the first slide-through element 2S, also when the weights are loaded in the weight pocket 10, enabling the scuba diver to simply and effectively adjust the first strap 3 around his or her body while donning and/or doffing the backrest.

It has been ascertained in practice that a backrest for a scuba diver according to the invention is particularly advantageous for opposing the torsion of the weight pocket on the single constraining strap in the abdominal position.

A further advantage of the invention is that of providing a backrest for a scuba diver in which the adjustment and/or the release of the single strap constraining it in the abdominal position is extremely simple and not hindered by torsion applied by the weight pocket on the strap itself.

A backrest for a scuba diver thus conceived is susceptible of numerous modifications and variants, all falling within the scope of the inventive concept as defined in the claims; furthermore, all of the details are replaceable by technically equivalent elements.

The materials used, as well as the dimensions, may in practice be any whatsoever, according to needs and the state of the art.

What is claimed is:

1. A backrest for a scuba diver comprising:

a shaped plate supporting at least one air cylinder, a first strap comprising an upper right portion configured to fit around the scuba diver's right shoulder, an upper left portion configured to fit around the scuba diver's left shoulder and a lower portion configured to fit around the scuba diver's abdomen, wherein said right upper portion, left upper portion, and lower portion are a single continuous strap, said shaped plate comprising a first right slide-through element and a first left slide-through element, adapted to connect said upper right portion and said upper left portion, respectively, to said lower portion of said first strap, a weight pocket that contains a weight, said weight pocket being constrained to said lower portion of said first strap, comprising an anti-torsion connector directly connecting said at least one weight pocket to said shaped plate and configured to oppose the torsion of said first strap in proximity to at least one of said first slide-through elements, wherein said anti-torsion connector comprises:

at least one fastening block fastening said weight pocket to said shaped plate, and at least one connecting piece connecting said weight pocket to said at least one fastening block.

2. The backrest for a scuba diver according to claim 1, wherein said weight pocket has at least a second slide-through element constraining to said first strap.

3. The backrest for a scuba diver according to claim 1, wherein said at least one fastening block is removably fastened to said shaped plate.

4. The backrest for a scuba diver according to claim 3, wherein said shaped plate is removably fastened with bolts.

5. The backrest for a scuba diver according to claim 1, wherein said at least one fastening block is configured not to interfere with said first right slide-through element or with said first left slide-through element of said first strap.

6. The backrest for a scuba diver according to claim 1, wherein said at least one connecting piece has one side fastened to said at least one fastening block, wherein the length of said side is not less than the width of said first strap.

* * * * *